United States Patent [19]

Dobelmann

[11] 3,932,917

[45] Jan. 20, 1976

[54] BUCKLE ASSEMBLY FOR MOTOR VEHICLE SAFETY BELTS

[75] Inventor: Jochen Dobelmann, Schwäbisch-Gmünd-Lindach, Germany

[73] Assignee: REPA GmbH Feinstanzwerk, Schwabisch-Gmund-Lindach, Germany

[22] Filed: Dec. 30, 1974

[21] Appl. No.: 537,387

[30] Foreign Application Priority Data

Dec. 31, 1973 Germany ..... 2365250

[52] U.S. Cl. ..... 24/230 A

[51] Int. Cl.[2] ..... A44B 11/26

[58] Field of Search ..... 24/230 A

[56] References Cited

UNITED STATES PATENTS

| | | | |
|---|---|---|---|
| 3,364,531 | 1/1968 | Moss | 24/230 A |
| 3,431,606 | 3/1969 | Jantzen | 24/230 A |

*Primary Examiner*—Bernard A. Gelak

*Attorney, Agent, or Firm*—Herbert L. Lerner

[57] ABSTRACT

Buckle assembly for motor vehicle safety belts including a buckle member and an insert tongue secured to a belt, the insert tongue being insertable in a given insertion direction into the buckle member so as to be secured in a locking position therein, the buckle member including a base plate, a latch member pivotally mounted on the base plate transversely to the given insertion direction, a spring-biased key depressible so as to pivot the latch member about the insert tongue in the locking position, the latch member being formed with a latch nose which, in the locking position of the insert tongue, engages in a recess formed in the insert tongue, the base plate being formed with a recess in a substantially central region thereof that is longer and wider than the latch member, the recess in the base plate being partly defined by a forward edge formed with ears having an open gap therebetween and bent at an angle initially outwardly and, in a free marginal region thereof, in the given insertion direction of the insert tongue, the latch member being formed with a hammerhead-like projection having a neck portion extending through the gap between the ears and, with the hammerhead portion thereof, engaging the ears from behind at the outside of the base plate.

3 Claims, 2 Drawing Figures

BUCKLE ASSEMBLY FOR MOTOR VEHICLE SAFETY BELTS

Figure 1:
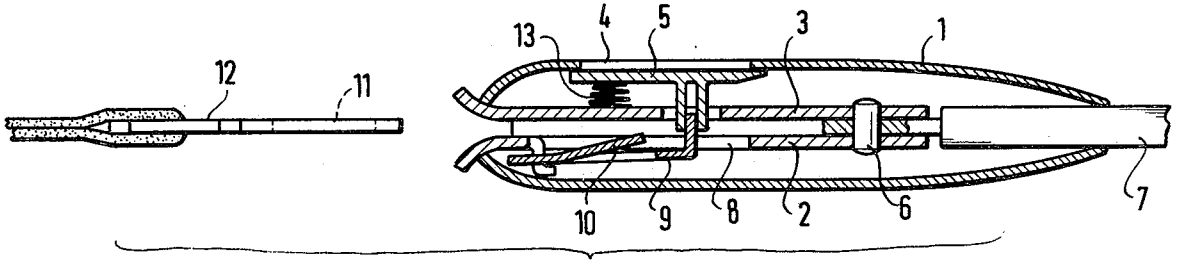

The invention relates to a buckle assembly for motor vehicle safety belts and, more particularly, to such a buckle assembly which includes a buckle member and a slider or insert tongue secured to a belt. The insert tongue is insertable in a given insertion direction into the buckle member so as to be secured in a locking position therein, the buckle member including a base plate, a latch member pivotally mounted on the base plate transversely to the given insertion direction, and a spring-biased key depressible so as to pivot the latch member about the insert tongue in the locking position, the latch member being formed with a latch nose which, in the locking position of the insert tongue, engages in a recess formed in the insert tongue.

In the heretofore known buckles or buckle assemblies of this general type, the latch member and the base plate are articulatingly linked to one another. Consequently, foreign matter which enters the buckle can cause clamping of the latch member and the base plate so that the buckle becomes jammed in the locking position, and can no longer be opened by depressing the key.

It has therefore been proposed heretofore to provide an opening in the base plate in the vicinity of the latch member in order to prevent clamping of foreign matter between the latch member and the base plate.

In these heretofore known devices, the connection of the latch member with the base plate have been found to be very unsatisfactory, however, and could, in any event, be effected only by using additional members.

It is accordingly an object of the invention to provide a buckle assembly for motor vehicle safety belts, in accordance with the invention, wherein the articulation of the latch member at the base plate is effected in an improved, simple and more reliable manner than was heretofore possible with previously known devices of this general type.

With the foregoing and other objects in view, there is provided, in accordance with the invention, a buckle assembly for motor vehicle safety belts comprising a buckle member and an insert tongue secured to a belt, the insert tongue being insertable in a given insertion direction into the buckle member so as to be secured in a locking position therein, the buckle member including a base plate, a latch member pivotally mounted on the base plate transversely to the given insertion direction, a spring-biased key depressible so as to pivot the latch member about the insert tongue in the locking position, the latch member being formed with a latch nose which, in the locking position of the insert tongue, engages in a recess formed in the insert tongue, the base plate being formed with a recess in a substantially central region thereof that is longer and wider than the latch member, the recess in the base plate being partly defined by a forward edge formed with ears having an open gap therebetween and bent at an angle initially outwardly and, in a free marginal region thereof, in the given insertion direction of the insert tongue, the latch member being formed with a hammerhead-like projection having a neck portion extending through the gap between the ears and, by the hammerhead portion thereof, engaging the ears from behind at the outside of the base plate.

Due to this construction of the base plate member and the latch member, in accordance with the invention, a reliable articulating connection is produced between both members without requiring any auxiliary members, by simply inserting the latch member, the members being readily disconnectible again when the buckle housing is removed.

In accordance with another feature of the invention, the base plate is formed with lateral projections, and a cover plate is spaced from the base plate a distance corresponding to the thickness of the insert tongue, the cover plate having side edges bent at an angle toward the base plate and formed with cut-outs wherein the lateral projections of the base plate engage.

By means of this feature of the invention, it is possible to form the base plate per se and bend the ears at an angle so as to form the articulating joint for the latch member, both in the same operation.

In accordance with a further feature of the invention which affords improved security against clamping due to foreign matter in the buckle interior, the key is connected to the latch member and has an inner surface, and the cover plate has an outer surface, and spring means are included, biasing the key and holding the latch member in the locking position, the spring means being disposed between the outer surface of the cover plate and the inner surface of the key, so that the space therebetween opposite the opening through which the insert tongue is inserted is largely closed. Conventional springs for ejecting the released insert tongue are advantageously mounted in guiding slots which are formed in the base plate laterally of the recess provided therein for the latch member.

Other features which are considered as characteristic for the invention are set forth in the appended claims.

Although the invention is illustrated and described herein as embodied in a buckle assembly for motor vehicle safety belts, it is nevertheless not intended to be limited to the details shown, since various modifications and structural changes may be made therein without departing from the spirit of the invention and within the scope and range of equivalents of the claims.

Figure 2:
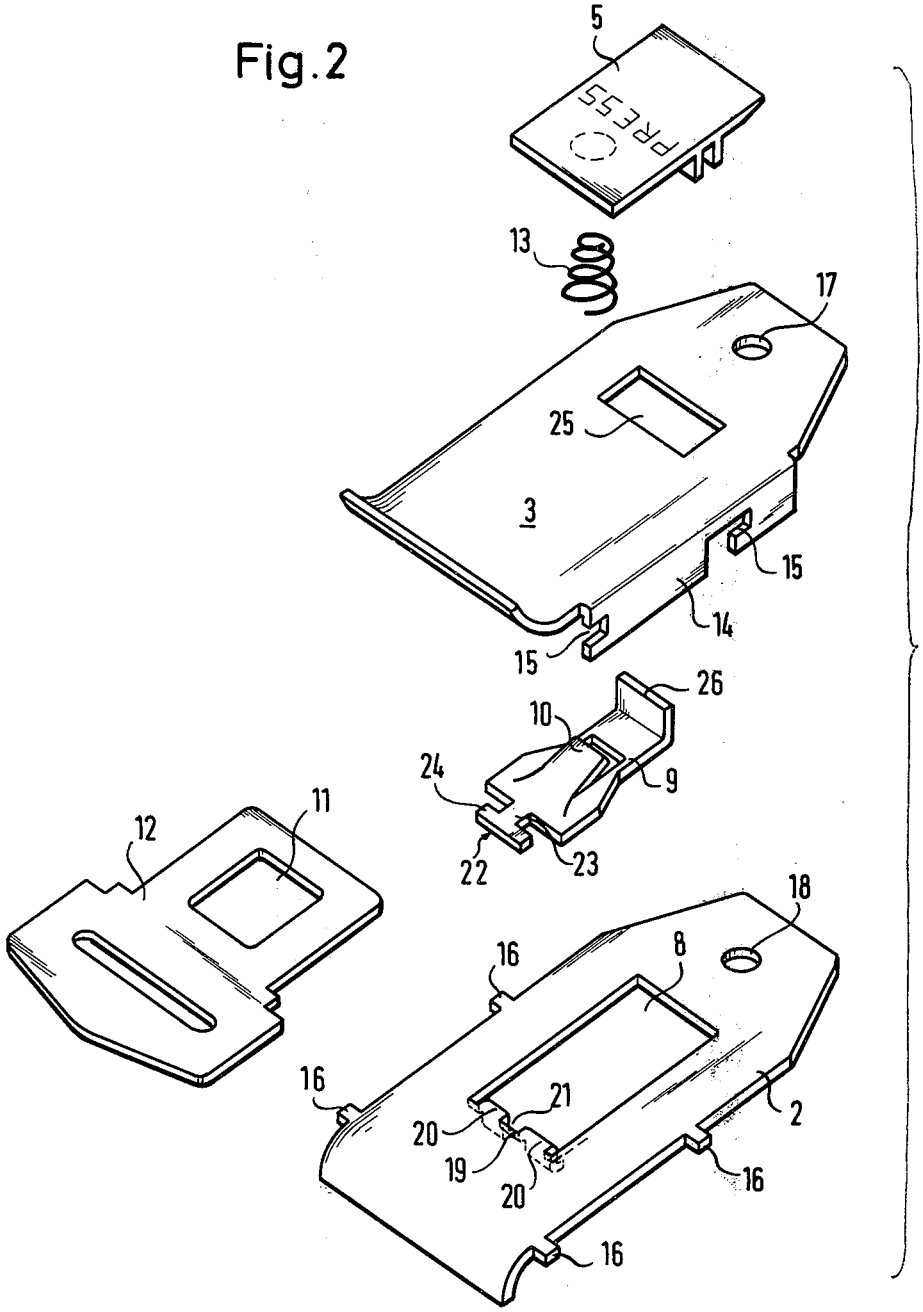

The construction and method of operation of the invention, however, together with additional objects and advantages thereof will be best understood from the following description of specific embodiments when read in connection with the accompanying drawings in which:

FIG. 1 is a longitudinal sectional view of a buckle and slider or insert tongue for motor vehicle safety belts constructed in accordance with the invention; and FIG. 2 is an exploded view, in perspective, of the buckle and slide of FIG. 1.

Referring now to the drawing, there is shown therein a buckle which is made up of a housing 1 surrounding a base plate 2 and a cover plate 3 and formed with a recess 4 in the vicinity of which, a depressible key 5 is disposed. The base plate 2 and the cover plate are connected one to the other by a rivet 6 which serves simultaneously as holding device for a connecting member 7. The base plate 2 is formed with a recess 8 which is longer and wider than a latch member 9 that is articulatingly linked to the base plate 2 and has a latch nose 10 that engages in a recess 11 formed in a slider or insert tongue 12 when the latter is inserted in locking position in the buckle. According to the exploded view of FIG. 2, the side edges 14 of the cover plate 3 are bent at an angle toward the base plate 2 and are formed with slots or cutouts 15 in which lateral projections 16 of the base plate 2 engage so that the base plate 2 and the cover plate 3 are spaced apart a distance corresponding to the thickness of the slider or insert tongue 12. By inserting the rivet 6 (FIG. 1) into the bores 17 and 18 of the cover plate 3 and the base plate 2, respectively, a form-locking connection of both the latter members is formed.

At the forward edge 19 of the recess 8 formed in the base plate 2, there are ears 20 which have an open gap 21 therebetween and are bent at an angle initially outwardly and in the free marginal region thereof in insertion direction of the slider or insert tongue 12. The latch member 9 is formed at the forward marginal region thereof with a hammerhead-like projection 22 having a neck poriton 23 extending through the gap 21 and engaging the ears 20 on the outside from behind by means of the head portion 24 thereof. The latch member 9 can be inserted into the recess 8 in perpendicular position to the base plate 2 and, by swinging toward the recess 8, articulatingly secured. After the cover plate 3 has been set on the base plate 2, the latch member 9 can no longer be removed from the bearing or support thereof. The key 5 is stuck onto angle projections 26 of the latch member 9 that extend through a recess 25 formed in the cover plate 3. All of the members forming the buckle of the invention are connected one to another without any other member except for the rivet 6. The housing 1 is of unitary construction and is formed of inherently rigid flexible material so that it can be slid in self-holding manner onto the mutually united buckle parts.

I claim:

1. Buckle assembly for motor vehicle safety belts comprising a buckle member and an insert tongue secured to a belt, said insert tongue being insertable in a given insertion direction into said buckle member so as to be secured in a locking position therein, said buckle member including a base plate, a latch member pivotally mounted on said base plate transversely to said given insertion direction, a spring-biased key depressible so as to pivot said latch member about said insert tongue in said locking position, said latch member being formed with a latch nose which, in said locking position of said insert tongue, engages in a recess formed in said insert tongue, said base plate being formed with a recess in a substantially central region thereof that is longer and wider than said latch member, said recess in said base plate being partly defined by a forward edge formed with ears having an open gap therebetween and bent at an angle initially outwardly and, in a free marginal region thereof, in said given insertion direction of said insert tongue, said latch member being formed with a hammerhead-like projection having a neck portion extending through said gap between said ears and, with said hammerhead portion thereof, engaging said ears from behind at the outside of said base plate.

2. Buckle assembly according to claim 1 wherein said base plate is formed with lateral projections, and including a cover plate spaced from said base plate a distance corresponding to the thickness of said insert tongue, said cover plate having side edges bent at an angle toward said base plate and formed with cut-outs wherein said lateral projections of said base plate engage.

3. Buckle assembly according to claim 2 wherein said key is connected to said latch member and has an inner surface, and said cover plate has an outer surface, and including spring means biasing said key and holding said latch member in said locking position, said spring means being disposed between said outer surface of said cover plate and said inner surface of said key.

* * * * *